US005709553A

United States Patent [19]

Opfer et al.

[11] Patent Number: 5,709,553

[45] Date of Patent: Jan. 20, 1998

[54] FLEXIBLE CONNECTOR FOR HIGH-CURRENT CONDUCTORS

[75] Inventors: John C. Opfer, Chicago; Buddy B. McGlone, Lombard, both of Ill.

[73] Assignee: S&C Electric Company, Chicago, Ill.

[21] Appl. No.: 713,940

[22] Filed: Sep. 13, 1996

[51] Int. Cl.[6] ..... H01R 35/04

[52] U.S. Cl. ..... 439/6; 174/86; 403/306

[58] Field of Search ..... 439/213, 210, 439/249, 251, 794, 797, 819, 6, 8, 115; 403/220, 229, 384, 388, 393, 300, 305, 306; 174/70 B, 71 B, 72 B, 86, 88 B

[56] References Cited

U.S. PATENT DOCUMENTS

| | | | |
|---|---|---|---|
| 3,679,029 | 7/1972 | Thomas | 403/388 |
| 3,842,187 | 10/1974 | Barkam | 439/8 |
| 3,967,083 | 6/1976 | Bould et al. | 403/388 |
| 4,798,492 | 1/1989 | Smith | 403/220 |
| 5,206,461 | 4/1993 | Genzel et al. | 174/88 B |

*Primary Examiner*—P. Austin Bradley
*Attorney, Agent, or Firm*—James V. Lapacek

[57] ABSTRACT

A flexible connection arrangement is provided for two conductors that accommodates all possible forms of misalignment between the two conductors. The connection arrangement utilizes spherical joints formed by facing hemispherical protuberances at each end of two movable links.

7 Claims, 2 Drawing Sheets

FLEXIBLE CONNECTOR FOR HIGH-CURRENT CONDUCTORS

BACKGROUND OF THE INVENTION

1. Field of the Invention

The present invention relates generally to connectors and more particularly to flexible connections between high-current conductors that provide reliable connection to conductors that may be out of alignment with respect to each other in every conceivable way (various degrees of freedom).

2. Description of the Related Art

There are many different types of connectors, one general category of which is flexible connectors. One type of flexible connector utilizes a braided conductor. For high current applications, not only is this expensive, but additionally, the conductor can move around due to electromagnetic forces and the strands of the conductor can break due to vibration.

While the prior art arrangements may be useful to provide flexible connections of various types, the prior arrangements are either complicated or unreliable.

SUMMARY OF THE INVENTION

Accordingly, it is a principal object of the present invention to provide a flexible connection arrangement for high current conductors.

It is another object of the present invention to provide a flexible connection arrangement that is slidable, rotatable, twistable and translatable.

These and other objects of the present invention are efficiently achieved by the provision of a flexible connection arrangement for two conductors that accommodates all possible forms of misalignment between the two conductors. The connection arrangement utilizes spherical joints formed by facing hemispherical protuberances at each end of two movable links.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
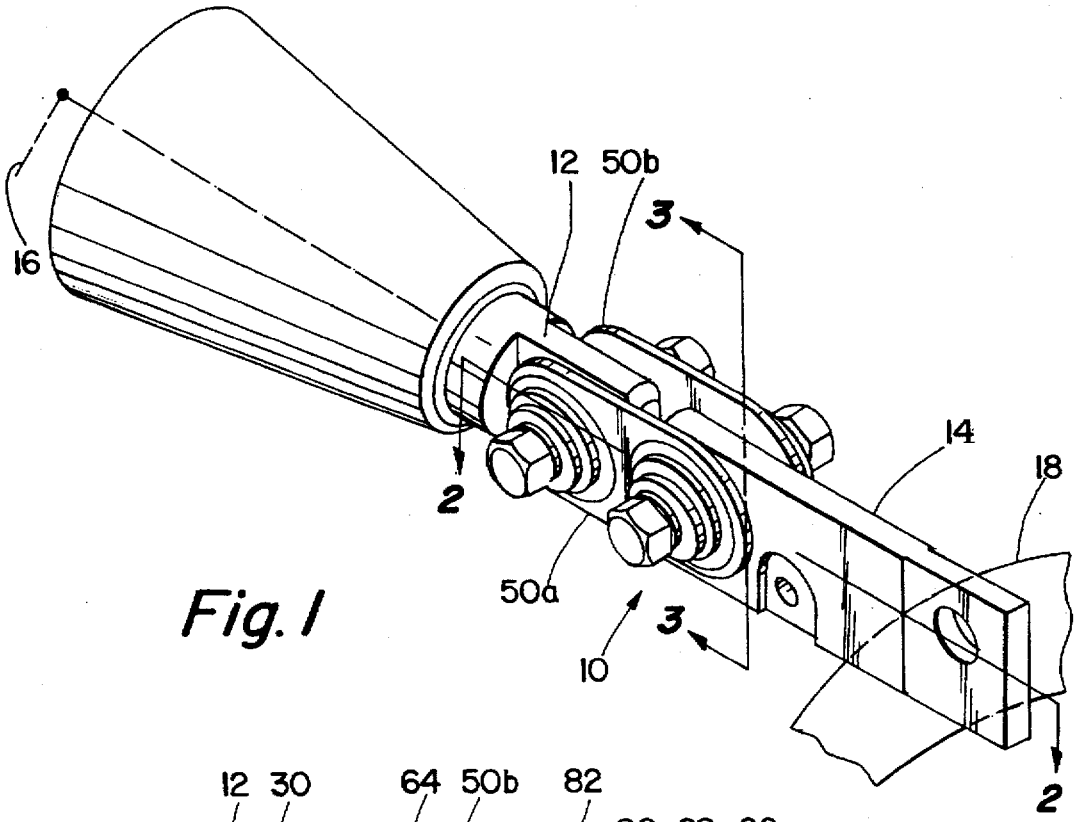
FIG. 1 is a perspective view of the connection arrangement of the present invention.
Figure 2:
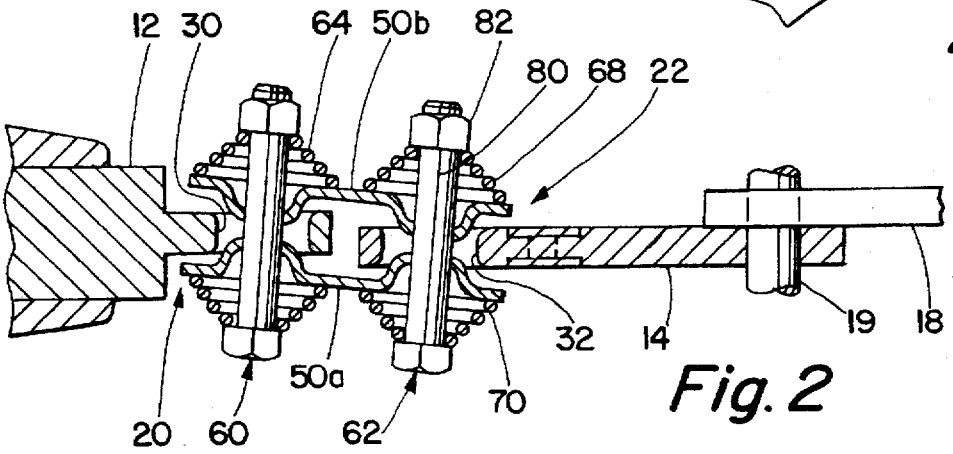
FIGS. 2 and 3 are sectional views taken generally along the lines 2—2 and 3—3 of FIG. 1 respectively.
Figure 3:
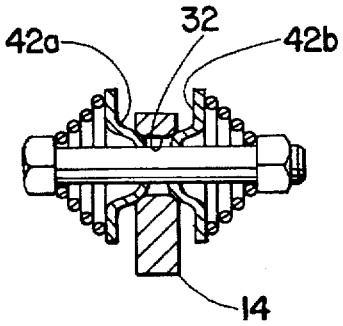
Figure 5:
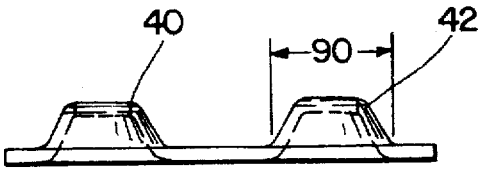
FIGS. 4–6 are respective front, top and right-side elevational views of a link member of the connection arrangement of FIGS. 1–3.
Figure 4:
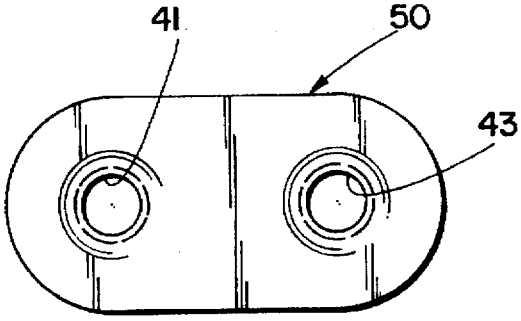
Figure 6:
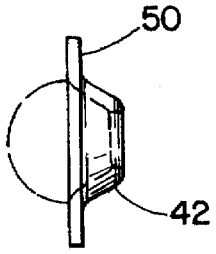
Figure 8:
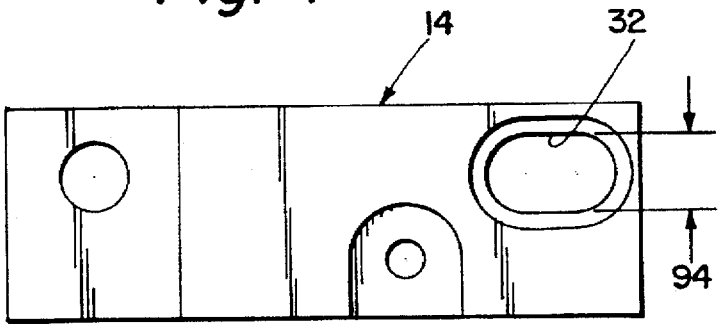
FIGS. 7–9 are respective perspective, front elevational and bottom plan views of a conductor including features of the present invention for use in the connection arrangement of FIGS. 1–3, FIG. 9 being partly in section.
Figure 9:
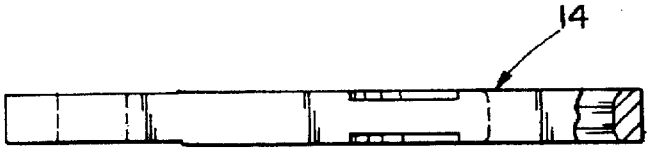
Figure 7:
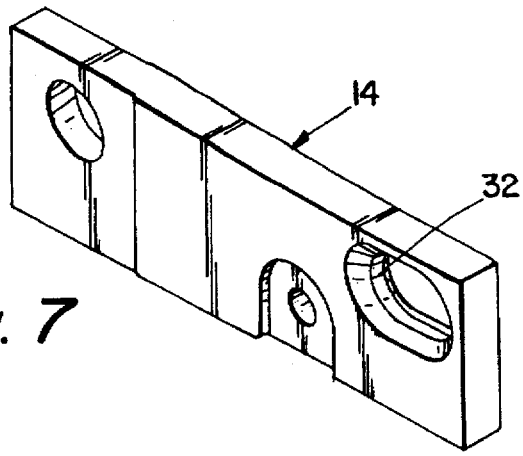

Referring now to FIGS. 1–3, the connection arrangement 10 of the present invention provides a flexible electrical connection between two conductors 12, 14, or alternatively between two other conductors or components 16, 18 which are respectively connected to the two conductors 12, 14, e.g. by a fastener 19 or the like connecting the conductor 14 to the conductor 18, the fastener 19 not being shown in FIG. 1 for clarity. The connection arrangement 10 includes two spherical joints 20, 22 each being defined by two portions of spherical surfaces that include outer spherical surfaces that are disposed on opposite sides of one of the two conductors 12, 14 at a respective slotted portion 30, 32 so as to face each other. In the specific illustration of FIGS. 1–3, and referring additionally now to FIGS. 4–6, the spherical joints 20, 22 are formed by protuberances 40, 42 on a link member 50, the protuberances 40, 42 being generally spherical portions that are approximate hemispheres. Specifically, two of the link members 50*a*, 50*b* are positioned such that the protuberances 40*a*, 40*b* and 42*a*, 42*b* face each other with the link members 50*a*, 50*b* being positioned on opposite sides of the conductors 12, 14. Each of the protuberances 40, 42 include respective central apertures 41, 43 formed therethrough. The link members 50*a*, 50*b* are assembled about the conductors 12, 14 via fasteners 60, 62 and biasing members 64, 66, 68 and 70. In the specific illustration, the biasing members 64, 66, 68 and 70 are conical springs and the fasteners 60, 62 are threaded bolts 80 cooperating with threaded nuts 82. One of the bolts 80 is positioned through the conical spring 66, the aperture 41*a*, through the slot 30, then through the conical spring 64, with the nut 82 threaded onto the bolt 80 and tightened so as to provide predetermined desirable compressive contact force between the two protuberances 40*a*, 40*b* that form the spherical joint 20 and the slot 30. The springs 64, 66, 68 and 70 thus provide suitable contact force and allow the joints to move. Electromagnetic forces resulting from high currents through the connector arrangement 10 serve to pull the link members 50*a* and 50*b* together. These electromagnetic forces are generally offset by the localized point contact blow-off forces. The contact surfaces are shown in FIG. 3, such that there are two contact points per hemispherical protuberance 40, 42 or four points for each spherical joint 20, 22.

Referring now additionally to FIGS. 4–9, the relative dimensions of the slots 30, 32 of the conductors 12, 14 and the external diameter of the protuberances 40, 42 of the link members 50 are arranged such that the external diameter 90 (FIG. 5) of the protuberances 40, 42 is somewhat larger than the width 94 of the slots 30, 32. The slots 30, 32 also include concave peripheral walls, i.e. flared outwardly, so as to provide suitable contact surfaces for the link members 50.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. An arrangement for providing a flexible connection between two conductors comprising: each of the conductors including an elongated slot, and flexible connection means cooperating with each of the conductors for providing a flexible connection between the conductors, said flexible connection means including first and second means for respectively providing a flexible connection to each of the conductors via the elongated slot therein, each of said first and second means including means for providing a generally spherical joint and third means for providing compressive contact force at each of said generally spherical joints, each of said generally spherical joints being defined by two portions of generally spherical surfaces having outer spherical surfaces that face each other with the conductor and elongated slot being located therebetween.

2. The arrangement of claim 1 wherein said first and second means comprise two link members each of which includes spaced apart protuberances defined by portions of generally spherical surfaces.

3. The arrangement of claim 2 wherein said third means comprises fourth means for resiliently fastening said two link members about the conductors.

4. The arrangement of claim 3 wherein said two link members include central apertures within each of said protuberances and said fourth means comprises fastener means extending through said facing protuberances and said elongated slot of the conductor.

5. The arrangement of claim 3 wherein said fourth means provides sufficient contact force to overcome predetermined high current conditions.

6. The arrangement of claim 1 wherein said elongated slots in the conductors include outwardly flared, tapered walls.

7. A flexible connector comprising:

two conductors, each of said conductors including an elongated slot; and flexible connection means cooperating with each of said conductors for providing a flexible connection between said conductors, said flexible connection means including first and second means for respectively providing a flexible connection to each of said conductors via said elongated slot, each of said first and second means including means for defining a connection joint and third means for providing compressive contact force at each of said connection joints, said connection joint being defined by two portions of generally spherical surfaces that face each other and are disposed on either side of said conductor and said elongated slot.

* * * * *